United States Patent [19]

Papay

[11] Patent Number: 4,795,583

[45] Date of Patent: Jan. 3, 1989

[54] SHIFT-FEEL DURABILITY ENHANCEMENT

[75] Inventor: Andrew G. Papay, Manchester, Mo.

[73] Assignee: Ethyl Petroleum Additives, Inc., St. Louis, Mo.

[21] Appl. No.: 138,332

[22] Filed: Dec. 28, 1987

[51] Int. Cl.[4] ..... C10M 133/36; C10M 133/54

[52] U.S. Cl. ..... 252/77; 252/51.5 R

[58] Field of Search ..... 252/51.5 R, 77

[56] References Cited

U.S. PATENT DOCUMENTS

| | | | |
|---|---|---|---|
| 2,758,086 | 8/1956 | Stuart et al. | 252/32.5 |
| 3,156,652 | 11/1964 | Foehr | 252/75 |
| 3,175,976 | 3/1965 | Foehr | 252/75 |
| 3,236,770 | 2/1966 | Matson et al. | 252/77 |
| 3,280,029 | 10/1966 | Waldmann | 252/77 |
| 3,311,560 | 3/1967 | Hotten | 252/75 |
| 3,396,109 | 8/1968 | Butler et al. | 252/32.7 |
| 3,450,636 | 6/1969 | Rausch | 252/75 |
| 3,578,595 | 5/1971 | Schlicht et al. | 252/75 |
| 3,630,918 | 12/1971 | Hotten et al. | 252/75 |
| 3,634,256 | 1/1972 | Bickham | 252/75 |
| 3,640,872 | 2/1972 | Wiley et al. | 252/75 |
| 3,775,324 | 11/1973 | McCoy et al. | 252/54.6 |
| 3,779,928 | 12/1973 | Schlicht | 252/75 |
| 3,933,659 | 1/1976 | Lyle et al. | 252/32.7 E |
| 3,974,081 | 8/1976 | Rutkowski et al. | 252/79 |
| 4,018,695 | 4/1977 | Heilman et al. | 252/73 |
| 4,036,768 | 7/1977 | Crawford et al. | 252/51.5 A |
| 4,100,209 | 7/1978 | Libbey | 568/918 D |
| 4,116,877 | 9/1978 | Outten et al. | 252/72 |
| 4,206,067 | 6/1980 | MacKinnon | 252/77 |
| 4,263,159 | 4/1981 | Berens et al. | 252/79 |
| 4,344,853 | 8/1982 | Gutierrez et al. | 252/33.6 |
| 4,396,518 | 8/1983 | Ryer et al. | 252/52 R |
| 4,400,284 | 8/1983 | Jessup et al. | 252/49.6 |
| 4,532,062 | 7/1985 | Ryer et al. | 252/78.1 |
| 4,618,436 | 10/1986 | Horodysky | 252/32.5 |
| 4,618,437 | 10/1986 | Horodysky | 252/32.5 |
| 4,637,885 | 1/1987 | Kuwamoto et al. | 252/32.5 |

FOREIGN PATENT DOCUMENTS 59-71395 4/1984 Japan .

OTHER PUBLICATIONS

Society of Automotive Engineers, Inc., "Dexron-II Automatic Transmission Fluid Performance", No. 740053, Haviland, et al., Feb. 25-Mar. 1, 1974.

Society of Automotive Engineers, Inc., "Bridging the Gap Between Dexron® II and Type F ATF, Deen, et al., Feb. 26-Mar. 2, 1978, pp. 1-13.

Dexron Automatic Transmission Fluid, Anderson, et al., Chapter 41, pp. 435,442 (undated).

*Primary Examiner*—Robert A. Wax

*Attorney, Agent, or Firm*—John F. Sieberth; David M. Bunnell

[57] ABSTRACT

Improved durability of shift-feel frictional characteristics in automotive transmission fluids is achieved by use of an initially substantially inert (friction-wise) compound—viz., an aliphatic tertiary amine having one long chain and two short chain groups—incorporated into a formulation which is otherwise balanced for initially good shift-feel frictional properties. When the fluid is subjected to the oxidative and thermal degradation conditions encountered under normal service conditions, the friction modifiers that give the fluid good initial shift-feel frictional properties degrade. However, as this occurs the aliphatic tertiary amine has itself been transformed by a mechanism that activates it so that in its new form it acquires the ability to provide good shift-feel properties. Thus this additive serves as a time-activated or delayed action substitute for the friction modifiers that have been degraded during service. The result is a continuation of good shift-feel performance over a long period of severe operation. In one embodiment of the invention, oil-soluble aliphatic diamines are used as the primary (i.e., initially effective) friction-reducing additives with which the delayed action tertiary amines are used. In another embodiment, the primary (i.e., initially effective) friction-reducing additives with which the delayed action tertiary amines are used are oil-soluble N-substituted dialkanolamines.

40 Claims, No Drawings

SHIFT-FEEL DURABILITY ENHANCEMENT

TECHNICAL FIELD

This invention relates to automatic transmission fluids and additives therefor which, during use, provide improvements in shift-feel durability.

BACKGROUND

Considerable effort has been devoted over the years to the provision of oil-soluble additive formulations for use in automatic transmission fluids. Many such fluids and additive formulations are available as articles of commerce, and the literature contains many references to suitable compositions of this type. See for example U.S. Pat. Nos. 3,311,560; 3,450,636; 3,578,595; 3,630,918; 3,640,872; 3,775,324; 3,779,928; 3,933,659; 3,974,081; 4,018,695; 4,036,768; 4,116,877; 4,263,159; 4,344,853; 4,396,518; and 4,532,062.

Although friction-reducing additives of various types have been proposed and used in automatic transmission fluids, their effectiveness generally diminishes with time, probably because of oxidative and thermal degradation of the additives during use.

THE INVENTION

In accordance with this invention improved durability of shift-feel frictional characteristics in automotive transmission fluids is achieved by use of an initially substantially inert (friction-wise) compound incorporated into a formulation which is otherwise balanced for initially good shift-feel frictional properties. When the fluid is subjected to the oxidative and thermal degradation conditions encountered under normal service conditions, friction modifiers that give the fluid good initial shift-feel frictional properties degrade, and the performance of the fluid would be expected to deteriorate. However by virtue of this invention this does not occur. Instead, the initially substantially inert (friction-wise) compound has itself been transformed by a mechanism that activates it so that in its new form it acquires the ability to provide good shift-feel properties. Thus the additive employed pursuant to this invention serves as a time-activated substitute for the friction modifiers that have been degraded during service. The result is a continuation of good shift-feel performance over a long period of severe operation.

The delayed action shift-feel durability improvers of this invention are oil-soluble aliphatic tertiary amines of the formula

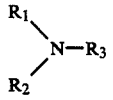

wherein $R_1$ and $R_2$ are, independently, alkyl or alkenyl groups of up to 4 carbon atoms each, and $R_3$ is a long chain substantially linear aliphatic group containing at least 10 carbon atoms. Preferably $R_1$ and $R_2$ are both alkyl groups, most preferably methyl. It is also preferred that $R_3$ be an alkyl, alkenyl or alkoxyalkyl group (although it may be alkynyl, alkylthioalkyl, haloalkyl, haloalkenyl or like aliphatic group), and it may contain as many as 50 or even 100 carbon atoms so long as the resultant long chain tertiary amine is oil-soluble—i.e., capable of dissolving to a concentration of 0.1% by weight at 25° C. in a paraffinic mineral oil having a viscosity in the range of 4 to 16 Centistokes at 100° C. Preferably $R_3$ contains up to about 30 carbon atoms.

As noted above, these compounds initially are substantially inert with respect to friction reduction in the fluid. During the time these compounds are being transformed into active friction-reducing substances, friction can be kept under control by other friction-reducing additives. Thus by the time the other friction-reducing additives have lost their effectiveness through degradation, the above aliphatic tertiary amines become activated through exposure to the same service conditions and once activated, commence serving as friction-reducing substances thereby substantially increasing the period of good shift-feel performance of the transmission fluid.

The precise mechanism of the transformation from inactive to active friction-reducing species experienced by the aliphatic tertiary amines is not known with certainty. However it is believed that this transformation involves at least in part an oxidative mechanism. Irrespective of the mechanism actually involved, its occurrence is eminently useful and desirable as it delays the onset of activity resulting from the aliphatic tertiary amine and thereby enables the prolongation of the useful shift-feel performance life of the transmission fluids.

A few exemplary aliphatic tertiary amines useful in the practice of this invention are the following:

N,N-dimethyl-N-decylamine
N,N-dimethyl-N-undecylamine
N,N-dimethyl-N-dodecylamine
N,N-dimethyl-N-tetradecylamine
N,N-dimethyl-N-hexadecylamine
N,N-dimethyl-N-eicosylamine
N,N-dimethyl-N-triacontylamine
N,N-dimethyl-N-tetracontylamine
N,N-dimethyl-N-pentacontylamine
N,N-diethyl-N-decylamine
N,N-diethyl-N-dodecylamine
N,N-diethyl-N-tridecylamine
N,N-diethyl-N-tetradecylamine
N,N-diethyl-N-hexadecylamine
N,N-diethyl-N-octadecylamine
N,N-diethyl-N-eicosylamine
N,N-dipropyl-N-decylamine
N,N-dipropyl-N-undecylamine
N,N-dipropyl-N-dodecylamine
N,N-dipropyl-N-tetradecylamine
N,N-dipropyl-N-hexadecylamine
N,N-dipropyl-N-octadecylamine
N,N-dipropyl-N-eicosylamine
N,N-dibutyl-N-decylamine
N,N-dibutyl-N-dodecylamine
N,N-dibutyl-N-tridecylamine
N,N-dibutyl-N-tetradecylamine
N,N-dibutyl-N-hexadecylamine
N,N-dibutyl-N-octadecylamine
N,N-dibutyl-N-eicosylamine
N,N-diisobutyl-N-decylamine
N,N-diisobutyl-N-undecylamine
N,N-diisobutyl-N-dodecylamine
N,N-diisobutyl-N-tetradecylamine
N,N-diisobutyl-N-hexadecylamine
N,N-di-sec-butyl-N-octadecylamine
N,N-di-sec-butyl-N-eicosylamine
N,N-dimethyl-N-decenylamine
N,N-dimethyl-N-triacontenylamine
N,N-diethyl-N-tetradecenylamine N,N-diethyl-N-octadecenylamine
N,N-dipropyl-N-2-methyloctadecylamine
N,N-divinyl-N-dodecylamine
N,N-diallyl-N-tetradecylamine
N,N-diallyl-N-hexadecylamine
N,N-dimethallyl-N-octadecylamine
N-ethyl-N-methyl-N-decenylamine
N,N-dimethyl-N-decyloxyethylamine
N,N-dimethyl-N-decyloxyethoxyethylamine
N,N-diethyl-N-tetradecyloxypropylamine
N,N-dimethyl-N-decenyloxyethylamine
N,N-dimethyl-N-tetradecynylamine
N,N-diethyl-N-octadecynylamine
N,N-dimethyl-N-octynyloxyethylamine
N,N-dimethyl-N-3-methylundecylamine
N,N-dimethyl-N-2,4,4-trimethyldodecylamine
N,N-dimethyl-N-2-ethyltetradecylamine
N,N-dimethyl-N-2-hexadecylamine
N,N-dimethyl-N-2,8-dimethyleicosylamine
N,N-dimethyl-N-10-methyl-3-triacontylamine Particularly preferred tertiary amines are N,N-dimethyl-N-octadecylamine and N,N-dimethyl-N-octadecenylamine, either singly or in combination with each other.

In accordance with one embodiment of this invention, certain oil-soluble aliphatic diamines are used as the primary (i.e., initially effective) friction-reducing additives with which the above delayed action tertiary amines are used. These aliphatic diamines may be represented by the formula $$R_4NH—R—NH_2$$

wherein R is an alkylene group of 2 to 5 carbon atoms, and $R_4$ is a long chain substantially linear aliphatic group containing at least 10 carbon atoms. In the above formula R is a divalent group such as dimethylene, tetramethylene, pentamethylene, 2-methyltrimethylene, and preferably, trimethylene, and $R_4$ is preferably alkyl, alkenyl or alkoxyalkyl (although it may be alkynyl, alkylthioalkyl, haloalkyl, haloalkenyl or like aliphatic group). Again there does not appear to be any critical upper limit on the number of carbon atoms in the long chain aliphatic group (in this case $R_4$), provided of course that the diamine meets the oil solubility parameter described above. Thus $R_4$ may contain as many as 50 or even 100 carbon atoms although preferably it contains no more than about 24 carbon atoms.

Illustrative aliphatic diamines of the above formula include:

N-decyl-1,2-ethylenediamine
N-decyl-1,3-propylenediamine
N-decyl-1,4-butylenediamine
N-decyl-1,5-pentylenediamine
N-decyl-1,3-neopentylenediamine
N-undecyl-1,2-ethylenediamine
N-dodecyl-1,3-propylenediamine
N-tridecyl-1,2-ethylenediamine
N-pentadecyl-1,3-propylenediamine
N-eicosyl-1,4-butylenediamine
N-tetracosyl-1,3-propylenediamine
N-triacontyl-1,3-propylenediamine
N-decenyl-1,5-pentylenediamine
N-octadecenyl-1,3-neopentylenediamine
N-decynyl-1,2-ethylenediamine
N-decyloxyethyl-1,3-propylenediamine
N-tetradecyloxyethoxyethyl-1,4-butylenediamine
N-decyloxybutyl-1,3-propylenediamine
N-(3-methylpentadecyl)-1,3-propylenediamine
N-(2,5,8-trimethyleicosyl)-1,4-butylenediamine
N-(2-ethylhexyloxyethyl)-1,3-propylenediamine
N-(1,1,3,3-tetramethylbutyloxyethyl)-1,3-propylenediamine In accordance with another embodiment of this invention, the primary (i.e., initially effective) friction-reducing additives with which the above delayed action tertiary amines are used are oil-soluble N-substituted dialkanolamines of the formula

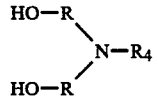

wherein R and $R_4$ are as defined above. Preferably the two R groups are identical (although they may differ from each other), and are straight chain alkylene groups, most preferably dimethylene.

A few exemplary N-substituted dialkanolamines that may be used in the practice of this invention are:

N-decyldiethanolamine
N-undecyldiethanolamine
N-dodecyldiethanolamine
N-tetradecyldiethanolamine
N-hexadecyldiethanolamine
N-octadecyldiethanolamine
N-eicosylethanolamine
N-triacontyldiethanolamine
N-decyldipropanolamine
N-tetradecyldipropanolamine
N-hexadecyldipropanolamine
N-octadecyldipropanolamine
N-decyldibutanolamine
N-tetradecyldibutanolamine
N-hexadecyloxyethyldiethanolamine
N-octadecyloxypropyldipropanolamine
N-tridecyldipentanolamine In still another embodiment of this invention the above aliphatic tertiary amine component is used in combination with both the above-described aliphatic diamine and the above-described N-substituted dialkanolamine components as a ternary friction-reducing additive complement.

It will be understood and appreciated that the above combinations of aliphatic tertiary amines with aliphatic diamines and/or N-substituted dialkanolamines may be used with any formulation of commonly used additives, such as rust or corrosion inhibitors, antioxidants, antiwear additives, antifoam additives, viscosity-index improvers, pour point depressants, dispersants, anti-squawk agents, other friction modifiers, and the like, provided only that such other additives do not adversely react with or otherwise materially impair the effectiveness of the additives of this invention. Since most, if not all, transmission fluids are devoid of substances that might be expected to interfere with the performance of the additive combinations of this invention, such as strong oxidizing agents or pro-oxidants, it is contemplated that the principles of this invention may be applied to most, if not all, present-day transmission fluids and additive formulations therefor. However in order to ascertain the effectiveness of any given additive combination of this invention in any given transmission fluid formulation, recourse can be had to the simple expedient of performing a few preliminary tests in the fluid with which it is desired to employ the additives of this invention. For this purpose use may be made of the test procedures described hereinafter.

The relative proportions of the tertiary amine component and the diamine and/or dialkanolamine component(s) that may be used in the practice of this invention may be varied to suit the needs of the occasion. Generally speaking the weight ratio of tertiary amine-diamine and/or alkanolamine will fall within the range of about 1:10 to about 10:1, and preferably within the range of about 4:1 to about 1:4. In the ternary systems of this invention the relative proportions of diamine:dialkanolamine can range all the way from a trace of one to a trace of the other. The concentration of the amine additive combinations of this invention in the automatic transmission fluid may be varied over relatively wide limits, although in most cases the base lubricating oil will contain from about 0.01 to about 1 weight percent, and preferably from about 0.02 to about 0.5 weight percent, of one of the amine additive combinations of this invention, based on the weight of the oil itself (apart from any other additives that may be present therein).

Automatic transmission fluids generally have a viscosity in the range of from about 75 to about 1,000 SUS (Saybolt Universal Seconds) at 100° F. and from about 35 to 75 SUS at 210° F. The base oils are usually light lubricating oils with viscosities normally falling within the range of about 50 to 400 SUS at 400° F. and 30 to 50 SUS at 210° F. The base stock is usually fractionated from petroleum. While it may be an aromatic fraction, it normally will be a naphthenic or paraffinic base stock, or a suitable blend of these. It may be unrefined, acid refined, hydrotreated, solvent refined, or the like. Synthetic oils meeting the necessary viscosity requirements, either with or without viscosity index improvers, may be employed as the base stock.

Numerous other additives that may be included in the compositions of this invention are described, for example in U.S. Pat. Nos. 3,156,652 and 3,175,976 as well as the various representative patents referred to at the outset hereinabove. All such disclosures are incorporated herein by reference for this purpose.

The amounts of such other additives used in forming the finished automatic transmission fluids will vary from case to case, but when used, typically fall within the following ranges:

| Component | Concentration Range, Volume % |
|---|---|
| V.I. Improver | 1–15 |
| Corrosion Inhibitor | 0.01–1 |
| Oxidation Inhibitor | 0.01–1 |
| Dispersant | 0.5–10 |
| Pour Point Depressant | 0.01–1 |
| Demulsifier | 0.001–0.1 |
| Anti-Foaming Agent | 0.001–0.1 |
| Anti-Wear Agent | 0.001–0.1 |
| Seal Swellant | 0.1–5 |
| Friction Modifier | 0.01–1 |
| Base oil | Balance |

The practice and advantages of this invention were illustrated by a series of tests using a standard test procedure for determining the effect of additives on friction coefficients, both static and dynamic. The test, referred to as the LVFA test procedure, involves use of the apparatus and procedure described in U.S. Pat. Nos. 4,252,973 and 4,511,482. These tests were run at 150° F. using between the plates either SD-1777 paper frictional material or SD-715 asbestos-containing paper frictional material.

In one set of examples, the mother blend was a Dexron®-II formulation, except that a friction modifier complement normally used therein was omitted. In Example 1 this mother blend was subjected to the above LVFA test without the inclusion of any friction modifier. In Examples 2 through 13 various additives were incorporated into the mother blend and the resultant compositions were subjected to the same tests. The additives so employed and the test results are shown in Table I.

TABLE I

LVFA TEST RESULTS ON FRICTION COEFFICIENT ($\times 10^{-3}$)

| | FRESH OIL | | | | | | OXIDIZED OIL (16 HR. HOOT) | | | | | | ST CHANGE |
|---|---|---|---|---|---|---|---|---|---|---|---|---|---|
| | SD 1777 | | | SD 715 | | | SD 1777 | | | SD 715 | | | SD 1777 |
| | ST | DYN | S-D | ST | DYN | S-D | ST | DYN | S-D | ST | DYN | S-D | $ST_{OX}$-$ST_{FR}$ |
| 1. Mother Blend (MB) | 176 | 144 | 32 | 187 | 151 | 36 | 179 | 146 | 33 | 191 | 151 | 40 | 3 |
| 2. MB + 0.03% Duomeen O | 128 | 129 | −1 | 134 | 135 | −1 | 187 | 147 | 40 | 191 | 155 | 36 | 59 |
| 3. MB + 0.05% Duomeen O | 121 | 127 | −6 | 126 | 137 | −11 | 187 | 161 | 26 | 197 | 172 | 25 | 66 |
| 4. MB + 0.13% Duomeen O | 116 | 125 | −9 | 120 | 125 | −5 | 154 | 138 | 16 | 166 | 146 | 20 | 38 |
| 5. MB + 0.23% Duomeen O | 108 | 121 | −13 | 113 | 125 | −12 | 147 | 138 | 9 | 159 | 146 | 13 | 39 |
| 6. MB + 0.03% Duomeen O + 0.10% Armeen DM18D | 129 | 131 | −2 | 133 | 135 | −2 | 140 | 135 | 5 | 153 | 144 | 9 | 11 |
| 7. MB + 0.03% Duomeen O + 0.10% Ethomeen T-12 | 115 | 127 | −12 | 118 | 131 | −13 | 158 | 145 | 13 | 167 | 158 | 9 | 43 |
| 8. MB + 0.03% Duomeen O + 0.10% Dimethyl Octadecane Phosphonate | 126 | 133 | −7 | 134 | 140 | −6 | 176 | 151 | 25 | 177 | 155 | 22 | 50 |
| 9. MB + 0.03% Duomeen O + 0.10% Isooctadecenyl succinimide | 122 | 130 | −8 | 129 | 137 | −8 | 180 | 157 | 23 | 185 | 167 | 18 | 58 |
| 10. MB + 0.03% Duomeen O + 0.10% Armeen OL | 114 | 125 | −11 | 118 | 130 | −12 | 182 | 160 | 22 | 190 | 173 | 17 | 68 |
| 11. MB + 0.03% Duomeen O + 0.10% Armid O | 117 | 127 | −10 | 123 | 133 | −10 | 172 | 154 | 18 | 177 | 163 | 14 | 55 |
| 12. MB + 0.03% Duomeen O + 0.10% Oleic Acid | 110 | 123 | −13 | 115 | 129 | −14 | 179 | 158 | 21 | 187 | 168 | 19 | 69 |
| 13. MB + 0.13% Armeen | 176 | 141 | 35 | 181 | 146 | 35 | 138 | 133 | 5 | 144 | 139 | 5 | −38 |

TABLE I-continued

| | LVFA TEST RESULTS ON FRICTION COEFFICIENT ($\times 10^{-3}$) | | | | | | | | | | | | |
|---|---|---|---|---|---|---|---|---|---|---|---|---|---|
| | FRESH OIL | | | | | | OXIDIZED OIL (16 HR. HOOT) | | | | | | ST CHANGE |
| | SD 1777 | | | SD 715 | | | SD 1777 | | | SD 715 | | | SD 1777 |
| | ST | DYN | S-D | ST | DYN | S-D | ST | DYN | S-D | ST | DYN | S-D | $ST_{OX}$-$ST_{FR}$ |
| DM18D | | | | | | | | | | | | | |

ST = Static Coefficient Tendency (Max. l below 10 Ft/min)
DYN = Dynamic Coefficient (l 40 Ft/min)
S-D = Difference between ST and DYN
$ST_{OX}$ = ST of oxidized oil
$ST_{FR}$ = ST of fresh oil It will be seen from Example 1 that the control blend showed a large Static-Dynamic differential value in the LVFA tests both in the fresh oil and in the oxidized oil. In Example 13, the addition to the blend of N,N-dimethyl-N-octadecylamine likewise gave a large Static-Dynamic differential value in the fresh oil tests. However on oxidation these differential values dropped greatly to only 5. This was accomplished by reduction of the static coefficient of friction ($ST_{OX}$-$ST_{FR}$) from 3 in Example 1 to −38 in Example 13. A generally low coefficient of static friction is generally indicative of a smooth shift-feel in an automatic transmission in which power is transmitted by friction clutches or bands.

Examples 2 through 5 show that Duomeen O (N-oleyl-1,3-propylenediamine or N-oleyl-1,3-trimethylenediamine), is an efficient friction modifier which imparts good initial properties to the fresh oil including smooth shift-feel characteristics. Unfortunately however, these characteristics do not survive long term oxidation as shown by the results in the oxidized oils of Examples 2 through 5. In these runs an increasing amount of Duomeen O produces increasingly negative S−D differential values in the fresh oil instead of large positive values as exhibited by the mother blend. The Duomeen O runs show high S-D differential values in the last column which shows that this additive did not reduce the static coefficient sufficiently and in some cases actually increased it.

However when, pursuant to this invention, the mother blend contained N,N-dimethyl-N-octadecylamine together with the typical long chain ($C_{10}$ to $C_{24}$) N-alkyl-1,3-propylenediamine (Duomeen O), even in the lowest amounts tested singly, friction modification was obtained both in the fresh oil and after oxidation. This is shown in Example 6.

Examples 7 through 12 of Table I illustrate the ineffectiveness of various other common friction modifiers used in combination with Duomeen O. These runs thus highlight the exceptional behavior of the combinations of this invention in providing long-lasting improvements in shift-feel durability. The chemical composition of these other additives identified in Table I by trade designations are as follows:

Ethomeen T-12—N-alkyl (tallow) diethanolamine
Armeen OL—Oleylamine
Armid O—Oleic acid amide In another series of runs the fully-formulated DEXRON-II automatic transmission fluid was used as the base oil and control. The friction modifier present in this base oil blend was 0.16 weight percent of a long-chain (tallow) N-alkyldiethanolamine. Various additives were blended with this base oil blend and all such compositions were subjected to the LVFA test procedure. The compositions tested and the results obtained therewith are reported in Table II. Additives identified by trade designations in Table II have the following compositions:

Armeen DM12D—N,N-dimethyl-N-dodecylamine
Armeen DM14D—N,N-dimethyl-N-tetradecylamine
Armeen DMOD—N,N-dimethyl-N-oleylamine
Armeen DM18D—N,N-dimethyl-N-octadecylamine
Armeen M2HT—N-methyl-N,N-dialkyl (tallow) amine
Armeen 2C—N,N-dialkyl (coco) amine
Armeen 2HT—N,N-dialkyl (tallow) amine
Duomac T—N-alkyl (tallow) trimethylene diammonium acetate
Ethomid O-17—N-(hydroxyethyl) penta-(oxyalkylene) oleamide
Ethoduomeen T-20—N-alkyl (tallow) N,N'-deca(oxyethylene) trimethylene diamine
Duomeen C—N-alkyl (coco) trimethylene diamine
Duomeen T—N-alkyl (tallow) trimethylene diamine
Duomeen O—N-alkyl (oleyl) trimethylene diamine
Duomeen TDO—N-alkyl (tallow) trimethylene diammonium oleate
Ethomeen-T12—N-alkyl (tallow) diethanolamine

TABLE II

| | LVFA TEST RESULTS ON FRICTION COEFFICIENT ($\times 10^{-3}$) | | | | | | | | | | | | |
|---|---|---|---|---|---|---|---|---|---|---|---|---|---|
| | FRESH OIL | | | | | | OXIDIZED OIL (16 HR. HOOT) | | | | | | ST CHANGE |
| | SD 1777 | | | SD 715 | | | SD 1777 | | | SD 715 | | | SD 1777 |
| | ST | DYN | S-D | ST | DYN | S-D | ST | DYN | S-D | ST | DYN | S-D | $ST_{OX}$-$ST_{FR}$ |
| 1. DEXRON ® II (D-II) | 124 | 130 | −6 | 129 | 133 | −4 | 154 | 147 | 7 | 160 | 154 | 6 | 30 |
| 2. D-II + 0.05% Armeen DM12D | 125 | 129 | −4 | 131 | 133 | −2 | 140 | 140 | 0 | 148 | 147 | 1 | 15 |
| 3. D-II + 0.05% Armeen DM14D | 122 | 128 | −6 | 127 | 132 | −5 | 135 | 138 | −3 | 143 | 146 | −3 | 13 |
| 4. D-II + 0.05% Armeen DM0D | 123 | 127 | −4 | 128 | 132 | −4 | 132 | 136 | −4 | 140 | 144 | −4 | 11 |
| 5. D-II + 0.05% Armeen DM18D | 126 | 130 | −4 | 130 | 133 | −3 | 128 | 135 | −7 | 132 | 137 | −5 | 2 |
| 6. D-II + 0.05% Armeen M2HT | 119 | 126 | −7 | 126 | 132 | −6 | 146 | 142 | 4 | 153 | 150 | 3 | 27 |
| 7. D-II + 0.05% Armeen 2C | 121 | 128 | −7 | 126 | 131 | −5 | 151 | 144 | 7 | 161 | 154 | 7 | 30 |
| 8. D-II + 0.05% Armeen 2HT | 124 | 128 | −4 | 128 | 132 | −4 | 151 | 144 | 7 | 161 | 153 | 8 | 27 |
| 9. D-II + 0.05% Duomac T | 112 | 125 | −13 | 118 | 130 | −12 | 154 | 147 | 7 | 161 | 154 | 7 | 42 |
| 10. D-II + 0.05% Ethomid 0-17 | 124 | 128 | −4 | 130 | 133 | −3 | 151 | 142 | 9 | 158 | 150 | 8 | 27 |

TABLE II-continued

LVFA TEST RESULTS ON FRICTION COEFFICIENT ($\times 10^{-3}$)

| | FRESH OIL | | | | | | OXIDIZED OIL (16 HR. HOOT) | | | | | | ST CHANGE |
|---|---|---|---|---|---|---|---|---|---|---|---|---|---|
| | SD 1777 | | | SD 715 | | | SD 1777 | | | SD 715 | | | SD 1777 |
| | ST | DYN | S-D | ST | DYN | S-D | ST | DYN | S-D | ST | DYN | S-D | $ST_{OX}$-$ST_{FR}$ |
| 11. D-II + 0.05% Ethoduomeen T-20 | 130 | 132 | −2 | 133 | 134 | −1 | 150 | 142 | 8 | 159 | 151 | 8 | 20 |
| 12. D-II + 0.05% Ethoduomeen T-13 | 123 | 128 | −5 | 128 | 133 | −5 | 161 | 150 | 11 | 161 | 153 | 8 | 38 |
| 13. D-II + 0.05% Duomeen C | 114 | 127 | −13 | 119 | 132 | −13 | 159 | 147 | 12 | 164 | 154 | 10 | 45 |
| 14. D-II + 0.05% Duomeen T | 107 | 124 | −17 | 111 | 127 | −16 | 148 | 144 | 4 | 156 | 153 | 3 | 41 |
| 15. D-II + 0.05% Duomeen O | 106 | 123 | −17 | 110 | 127 | −17 | 140 | 133 | 7 | 147 | 141 | 6 | 34 |
| 16. D-II + 0.05% Duomeen TDO | 110 | 124 | −14 | 114 | 129 | −15 | 151 | 145 | 6 | 158 | 151 | 7 | 41 |
| 17. D-II + 0.05% Ethomeen T-12 | 121 | 127 | −6 | 125 | 130 | −5 | 135 | 132 | 3 | 143 | 140 | 3 | 14 |
| 18. D-II + 0.02% Duomeen O + 0.03% Armeen DM 18D | 112 | 126 | −14 | 117 | 130 | −13 | 130 | 137 | −7 | 137 | 144 | −7 | 18 |

ST = Static Coefficient Tendency (Max. μ below 10 Ft/min)
DYN = Dynamic Coefficient (μ'Ft/min)
S-D = Difference between ST and DYN
$ST_{OX}$ = ST of oxidized oil
$ST_{FR}$ = ST of fresh oil Referring to the data in Table II it will be seen from Example 1 that the DEXRON-II base oil possessed suitable friction modifier needed at the initial stages of the test. However, the friction modifier therein (N-tallow alkyl-diethanolamine) did not survive in the oxidized oil. In contrast, in Examples 2 through 5 of Table II the presence in the blend of the combination of the N-tallow alkyl-diethanolamine and various aliphatic tertiary amines pursuant to this invention provided prolonged friction modification. Examples 6 through 16 show that several other types of amine derivatives and one amide derivative did not provide friction modification after oxidation when used in combination with the N-tallow alkyl-diethanolamine. In Example 18 a ternary friction modifier of this invention was employed, namely the combination of N,N-dimethyl-N-octadecylamine, a long chain (C10 to C24) N-alkyl-1,3-propylenediamine and N-tallow alkyl-diethanolamine and satisfactory results were achieved as regards friction modification.

While this invention has been discussed with reference to automatic transmission fluids, the additive combinations described herein can be successfully used as friction modifiers in other power transmission shift fluids such as hydraulic fluids, power brake and power steering fluids, heavy duty equipment fluids, universal heavy duty oils for diesel powered equipment, and the like.

This invention is susceptible to considerable variation in its practice within the spirit and scope of the appended claims.

What is claimed is:

1. An automatic transmission fluid composition comprising a major amount of an oil of lubricating viscosity and a friction modifying amount of:

(a) an oil-soluble aliphatic tertiary amine of the formula

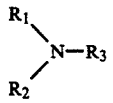

wherein $R_1$ and $R_2$ are, independently, alkyl or alkenyl groups of up to 4 carbon atoms each, and $R_3$ is a long chain substantially linear aliphatic group containing at least 10 carbon atoms; and either (b) an oil-soluble aliphatic diamine of the formula $R_4NH—R—NH_2$ wherein R is an alkylene group of 2 to 5 carbon atoms, and $R_4$ is a long chain substantially linear aliphatic group containing at least 10 carbon atoms; or (c) an oil-soluble N-substituted dialkanolamine of the formula

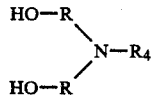

wherein R and $R_4$ are as defined above; or (d) a combination of said oil-soluble aliphatic diamine and said oil-soluble N-substituted dialkanolamine.

2. A composition according to claim 1 wherein $R_1$ and $R_2$ are both alkyl groups.

3. A composition according to claim 1 wherein $R_1$ and $R_2$ are both methyl groups.

4. A composition according to claim 1 wherein $R_3$ is an alkyl, alkenyl, or alkoxyalkyl group having up to about 30 carbon atoms.

5. A composition according to claim 1 wherein component (a) is N,N-dimethyl-N-octadecylamine or N,N-dimethyl-N-octadecenylamine, or both.

6. A composition according to claim 1 containing components from (a) and (b) thereof.

7. A composition according to claim 6 wherein R is trimethylene.

8. A composition according to claim 6 wherein $R_4$ is an alkyl, alkenyl, or alkoxylalkyl group.

9. A composition according to claim 6 wherein R is trimethylene and $R_4$ is an alkyl group having up to about 24 carbon atoms.

10. A composition according to claim 9 wherein $R_1$ and $R_2$ are both alkyl groups and $R_3$ is an alkyl, alkenyl, or alkoxyalkyl group having up to about 30 carbon atoms.

11. A composition according to claim 10 wherein $R_1$ and $R_2$ are both methyl groups.

12. A composition according to claim 11 wherein component (a) is N,N-dimethyl-N-octadecylamine or N,N-dimethyl-N-octadecenylamine, or both.

13. A composition according to claim 1 containing components from (a) and (c) thereof.

14. A composition according to claim 13 wherein R is dimethylene.

15. A composition according to claim 13 wherein $R_4$ is an alkyl, alkenyl, or alkoxylalkyl group.

16. A composition according to claim 13 wherein R is dimethylene and $R_4$ is an alkyl group having up to about 24 carbon atoms.

17. A composition according to claim 13 wherein $R_1$ and $R_2$ are both alkyl groups and $R_3$ is an alkyl, alkenyl, or alkoxyalkyl group having up to about 30 carbon atoms.

18. A composition according to claim 17 wherein $R_1$ and $R_2$ are both methyl groups.

19. A composition according to claim 18 wherein component (a) is N,N-dimethyl-N-octadecylamine or N,N-dimethyl-N-octadecenylamine, or both.

20. A composition according to claim 1 containing components from (a) and (d) thereof.

21. In an additive formulation for automatic transmission fluids, the improvement pursuant to which said formulation contains a friction modifier composed of:

(a) an oil-soluble aliphatic tertiary amine of the formula

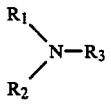

wherein $R_1$ and $R_2$ are, independently, alkyl or alkenyl groups of up to 4 carbon atoms each, and $R_3$ is a long chain substantially linear aliphatic group containing at least 10 carbon atoms; and either (b) an oil-soluble aliphatic diamine of the formula $R_4NH—R—NH_2$ wherein R is an alkylene group of 2 to 5 carbon atoms, and $R_4$ is a long chain substantially linear aliphatic group containing at least 10 carbon atoms; or (c) an oil-soluble N-substituted dialkanolamine of the formula

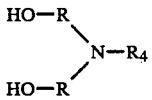

wherein R and $R_4$ are as defined above; or (d) a combination of said oil-soluble aliphatic diamine and said oil-soluble N-substituted dialkanolamine.

22. A composition according to claim 21 wherein $R_1$ and $R_2$ are both alkyl groups.

23. A composition according to claim 21 wherein $R_1$ and $R_2$ are both methyl groups.

24. A composition according to claim 21 wherein $R_3$ is an alkyl, alkenyl, or alkoxyalkyl group having up to about 30 carbon atoms.

25. A composition according to claim 2 wherein component (a) is N,N-dimethyl-N-octadecylamine or N,N-dimethyl-N-octadecenylamine, or both.

26. A composition according to claim 21 containing components from (a) and (b) thereof.

27. A composition according to claim 26 wherein R is trimethylene.

28. A composition according to claim 26 wherein $R_4$ is an alkyl, alkenyl, or alkoxylalkyl group.

29. A composition according to claim 26 wherein R is trimethylene and $R_4$ is an alkyl group having up to about 24 carbon atoms.

30. A composition according to claim 29 wherein $R_1$ and $R_2$ are both alkyl groups and $R_3$ is an alkyl, alkenyl, or alkoxyalkyl group having up to about 30 carbon atoms.

31. A composition according to claim 30 wherein $R_1$ and $R_2$ are both methyl groups.

32. A composition according to claim 31 wherein component (a) is N,N-dimethyl-N-octadecylamine or N,N-dimethyl-N-octadecenylamine, or both.

33. A composition according to claim 21 containing components from (a) and (c) thereof.

34. A composition according to claim 33 wherein R is dimethylene.

35. A composition according to claim 33 wherein $R_4$ is an alkyl, alkenyl, or alkoxylalkyl group.

36. A composition according to claim 33 wherein R is dimethylene and $R_4$ is an alkyl group having up to about 24 carbon atoms.

37. A composition according to claim 33 wherein $R_1$ and $R_2$ are both alkyl groups and $R_3$ is an alkyl, alkenyl, or alkoxyalkyl group having up to about 30 carbon atoms.

38. A composition according to claim 37 wherein $R_1$ and $R_2$ are both methyl groups.

39. A composition according to claim 38 wherein component (a) is N,N-dimethyl-N-octadecylamine or N,N-dimethyl-N-octadecenylamine, or both.

40. A composition according to claim 21 containing components from (a) and (d) thereof.

* * * * *

UNITED STATES PATENT AND TRADEMARK OFFICE

CERTIFICATE OF CORRECTION

PATENT NO. : 4,795,583

DATED : January 3, 1989

INVENTOR(S) : Andrew G. Papay

It is certified that error appears in the above-identified patent and that said Letters Patent is hereby corrected as shown below:

Column 5, lines 8-9 reads "amine-diamine" and should read -- amine:diamine --.

Column 12, line 17 reads "Claim 2" and should read -- Claim 21 --.

Signed and Sealed this

Thirteenth Day of June, 1989

*Attest:*

*Attesting Officer*

DONALD J. QUIGG

*Commissioner of Patents and Trademarks*